United States Patent [19]

Adams

[11] Patent Number: 4,738,399

[45] Date of Patent: Apr. 19, 1988

[54] DECOKING TOOL

[75] Inventor: Douglas Adams, West Orange, N.J.

[73] Assignee: Dresser Industries, Inc., Dallas, Tex.

[21] Appl. No.: 801,353

[22] Filed: Nov. 25, 1985

[51] Int. Cl.[4] ..... C10C 3/18

[52] U.S. Cl. ..... 239/447; 137/624.13; 137/624.18

[58] Field of Search ..... 239/436, 312, 443–446, 239/447; 251/62, 63; 137/624.13, 624.11, 624.18, 625.15, 624.14, 119

[56] References Cited

U.S. PATENT DOCUMENTS

| | | | |
|---|---|---|---|
| 257,694 | 5/1882 | Haight | 251/62 X |
| 463,623 | 11/1891 | Eichbaum | 251/63 X |
| 2,217,360 | 10/1940 | Court | 141/1 |
| 2,245,554 | 6/1941 | Court | 15/4 |
| 2,254,848 | 9/1941 | Holueck . | |
| 2,294,719 | 9/1942 | Court . | |
| 3,096,790 | 7/1963 | Chatham et al. | 137/119 X |
| 3,345,915 | 10/1967 | Dotto | 137/624.1 B X |
| 3,502,269 | 3/1970 | Robertson | 137/624.13 X |
| 3,656,707 | 4/1972 | Marotta | 251/62 |
| 3,702,685 | 11/1972 | Kirschke | 239/533.1 |
| 3,836,434 | 9/1974 | Novy . | |
| 3,964,516 | 6/1976 | Purton et al. | 137/625 |
| 4,178,954 | 12/1979 | Klieves | 137/119 |
| 4,275,842 | 6/1981 | Purton et al. | 239/446 |

*Primary Examiner*—Andres Kashnikow

*Assistant Examiner*—Kevin Patrick Weldon

[57] ABSTRACT

A hydraulically operated decoking tool capable of performing both boring and cutting operations with a simplified changeover between the operations that does not require removal of the tool from a coke bed is disclosed. The tool includes a body fabricated of durable material capable of withstanding the harsh environment in which it is used. Boring nozzles for boring a pilot hole in a coke bed and cutting nozzles for cutting up the coke for removal are provided on the tool. A coke bed is bored and cut by high pressure working fluid directed through the nozzles in a predetermined sequence. In the normal sequence, the boring operation is performed first followed by the cutting operation. The sequence of operations is controlled by a working fluid actuated shuttle sleeve or valve reciprocally mounted in the tool body. The sleeve is reciprocated by working fluid pressure moving from a first position corresponding to the boring operation to a second position corresponding to the cutting operation. In the first position, the sleeve blocks flow of working fluid to the cutting nozzles and opens flow of working fluid to the boring nozzles. Changeover between boring and cutting operations occurs automatically using working fluid pressure without the need to remove the tool from the coke bed and may be accomplished by an operator at a remote location through the use of a pilot valve.

11 Claims, 5 Drawing Sheets

DECOKING TOOL

BACKGROUND OF THE INVENTION

A. Field of the Invention

The present invention relates to a new and improved tool for removing coke from containers such as coke drums used in oil refining, and more specifically, to a new and improved decoking tool capable of automatically performing both boring and cutting operations using working fluid pressure to effect changeover between the operations.

B. Description of the Background Art

Part of oil refinery process is called delayed coking. Delayed coking involves distilling heavy oils to more valuable lighter distillate hydrocarbons (gas, gas-oil, gasoline). In this process, oil to be converted is fed into a fractionator where some of the lighter hydrocarbon constituents vaporize. The remaining heavy oils leave the bottom of the fractionator, are heated to about 900° F. in a furnace and are injected into a coke drum. Breaking up of the heavy oil molecules takes place in the drum. The involved thermal cracking process in breaking up the molecules combines high temperature and pressure causing the product to break down into a lighter hydrocarbon gas, which is removed at the top of the drum, and coke which forms as a solid in the drum.

Hydraulic decoking is a method of removing solid coke from the coke drum. By this method coke is removed by means of high-impact-producing water jets. Hydraulic nozzles are incorporated in decoking tools, mounted at the end of a hollow drill stem. The tool is lowered into the coke chamber and coke is removed in two steps. First, a pilot hole is bored downward through the coke bed and second, the coke is cut and removed from the chamber.

The first step involves directing jets forward of the tool into the coke bed boring a hole of 24 to 38 inches in diameter through the solid bed of coke. For the second operation, the tool is lowered into the chamber and nozzles direct jets of water outwardly from the tool. The jets or streams of water penetrate the coke bed to the chamber wall to break the coke away from the wall and at the same time clean the side wall of the chamber. The coke bed is normally cut in layers as the cutting tool is advanced in successive steps by the operator. The water supply to the cutting nozzles is furnished by a high pressure multi-stage centrifugal pump at a remote location. The water supply is typically a large volume settling pond. During the decoking operation, the water entrains contaminants, including coke fines. After use, the water is collected and recirculated to the pond to allow entrained contaminants to settle out, with the water being reused and recirculated when it has become sufficiently clarified to permit reuse. Even so, coke fines remain in the water and are continuously recycled through the pump and decoking tool.

Hydraulic decoking systems have been in operation since the early 1930's. Since the inception of hydraulic decoking, the process has entailed separate boring and cutting operations and separate tools as exemplified by U.S. Pat. Nos. 2,245,554; 2,217,360; 2,254,848 and 2,294,719. The boring operation makes a pilot hole through the coke bed to allow the subsequent cutting operation product to exit the drum. Normally two separate tools are used. The first is a boring tool which is used to drill the pilot hole through the coke bed. The initial hole is created by a high pressure water jet. The boring tool has boring nozzles and clean-out nozzles. Protective blades are evenly placed around the tool to prevent large lumps of coke from clogging the nozzles while it is being withdrawn from the chamber. It is possible for fines to settle over the boring tool if boring is stopped for any reason before breaking through the coke bed. If fines should settle over the boring tool, the tool would be held and removal could be prevented or hampered. The purpose of the clean-out nozzles is to stir up these fines and loosen the tool allowing removal or continuation of the boring operation. The second tool is the final cutting tool. The final cutting tool includes cutting nozzles used to decoke the chamber after the pilot hole has been drilled in the chamber.

Using two tools requires complete depressurization of the boring tool, withdrawal of the tool from the coke drum, removal, replacement with the cutting tool, reentry, and repressurization between operations. These steps are extremely time- consuming and awkward.

Alternative designs providing both boring and cutting operations in one tool have been suggested but have several disadvantages. A lever operated tool disclosed in U.S. Pat. No. 3,836,434 employs a relatively complex linkage mechanism that prohibits the use of different specialized nozzles for the two operations, and requires partial withdrawal of the tool to accomplish changeover in operations.

Other cutting tools that perform both operations use a sleeve and piston valve which causes considerable disruption of the cutting water at the nozzle inlets and requires the steps of complete depressurization, complete tool removal, mechanical manipulation, attachment of motive air, reentry, and repressurization to perform the changeover operation. Tools of this type using sliding valves to direct fluid to boring nozzles and cutting nozzles are disclosed in U.S. Pat. Nos. 4,275,842 and 3,964,516 and 3,702,685. These tools require manual manipulation or biasing springs for changeover between operations. These requirements greatly complicate the use of these tools. There is a need for a decoking tool that can be changed in operation without removing the tool from the coke bed and having the capability of changeover from one operation to another by an operator at a remote location. Such a tool would substantially reduce the time required and cost incurred to clean a coke chamber.

SUMMARY OF THE INVENTION

An object of the present invention is to provide a new and improved tool for removing coke from a coke drum.

Another object of the present invention is to provide a new and improved hydraulically-operated decoking tool capable of performing both boring and cutting operations.

A further object of the present invention is to provide a new and improved hydraulically-operated decoking tool that uses its own working fluid to accomplish automatically the changeover between boring and cutting operations without the need for removing the tool from the coke bed or requiring the operator to handle the tool.

Briefly, the present invention is directed to a new and improved hydraulically-operated decoking tool capable of performing boring and cutting operations with a simplified automatic changeover between operations that does not require the tool to be handled by the operator. For purposes of the present invention, "coke" is herein defined as any solid residue left from the distillation of crude oil or any fraction thereof. The tool includes a body of durable material such as cast steel. During the boring operation, jets of pressurized working fluid are directed through tool boring nozzle on a boring head defined on the tool body. Pressurized working fluid directed through the boring nozzles against a coke bed bore a pilot hole in the bed. A cutting head with a plurality of cutting nozzles is also provided on the tool body. At completion of the boring operation, pressurized working fluid is diverted from the boring nozzles to the cutting nozzles for performance of the cutting operation.

Changeover from the boring operation to the cutting operation occurs automatically and simply without the need for the tool operator to remove or handle the tool. Changeover is accomplished using working fluid pressure and a shuttle valve. The shuttle valve is reciprocally mounted in the tool body and directs fluid to the boring or cutting nozzles. The shuttle valve includes a flange or differential area which functions as a pressure reactive surface. By directing working fluid pressure to one side of the flange or area and venting the other side, the shuttle valve is shifted from a first to a second position changing the operation of the tool.

In the first position of the shuttle valve, flow of working fluid to the cutting nozzles is blocked and flow to the boring nozzles is opened. This corresponds to the boring operation of the tool. In the second position of the shuttle valve, flow of working fluid to the boring nozzles is blocked while flow to the cutting nozzles is opened. This corresponds to the cutting operation of the tool. In both positions of the shuttle valve full working pressure is directed by the shuttle valve to either the cutting or boring nozzles insuring maximum boring and cutting efficiency.

Simplified changeover by an operator at a remote location is possible through the employment of a pilot valve that actuates the shuttle valve. The pilot valve directs working fluid pressure to a selected side of the flange or differential area of the shuttle valve and vents the other side. The pilot valve is actuated by an operator at a remote location by partially depressurizing and repressurizing the tool. Springs biasing a sliding valve or the need for removal of the tool from the coke bed and manual manipulation of the tool all necessary in the prior art to accomplish changeover is not required in the tool of the present invention.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 3B' is a vertical, cross sectional, partial view of the shuttle valve of the tool in the cutting mode.

DETAILED DESCRIPTION OF A PREFERRED EMBODIMENT

Figure 1:
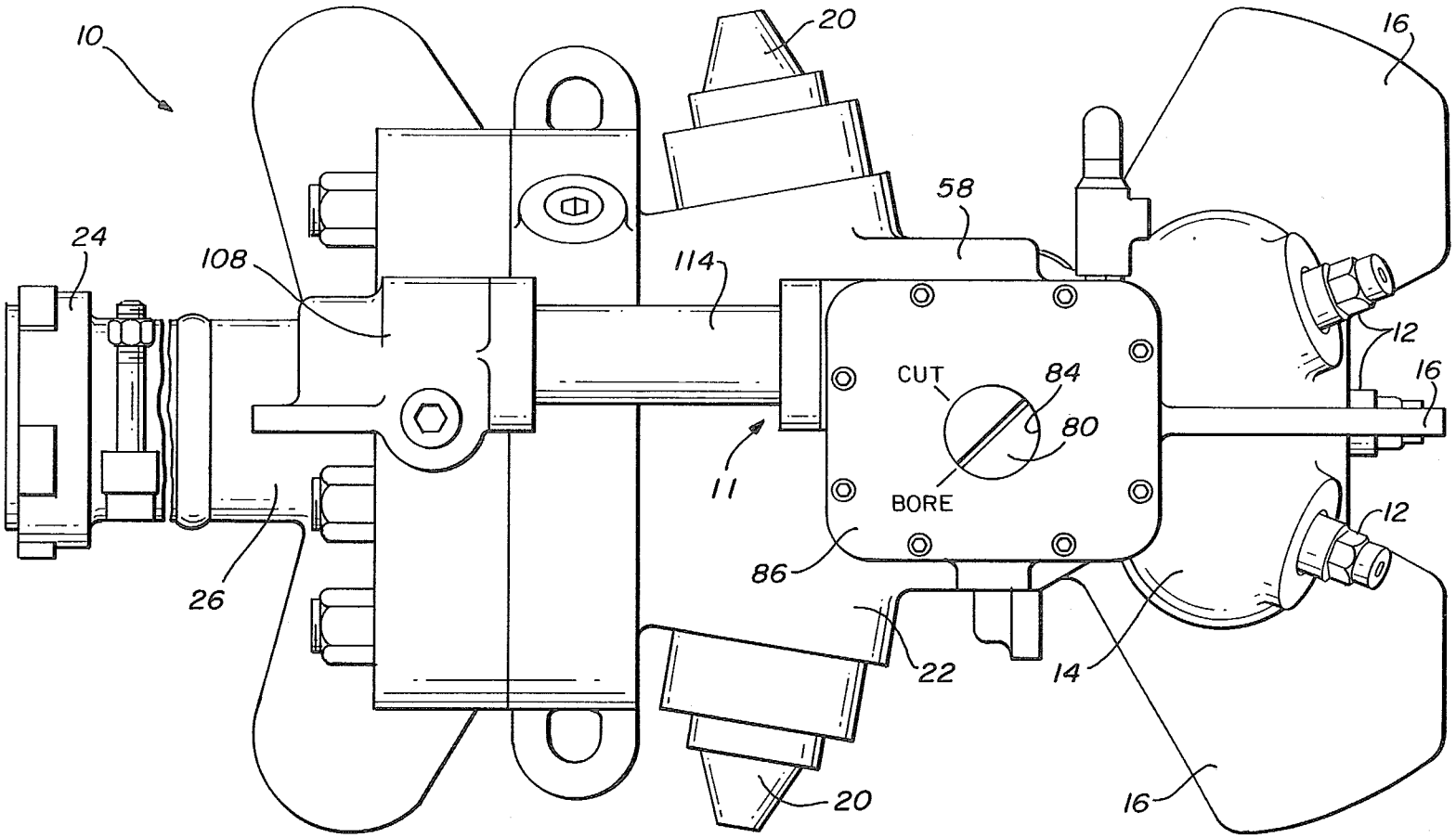
FIG. 1 is a side elevational view of a decoking tool capable of simple and automatic changeover between boring and cutting operations without removal of the tool from a coke bed.
Figure 2:
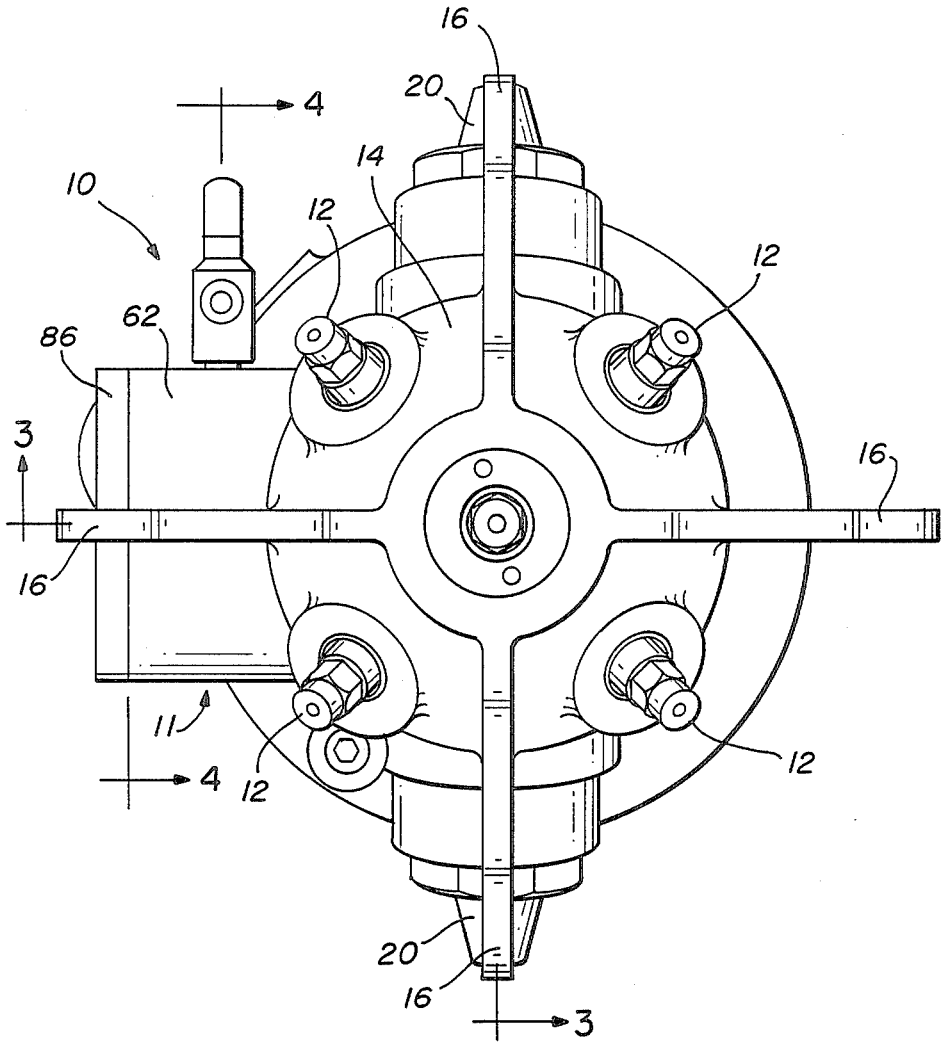
FIG. 2 is an end elevational view of the decoking tool illustrated in FIG. 1 looking at the boring head end of the tool.

Referring now to the drawings, there is illustrated a decoking tool generally designated by the reference numeral 10. Decoking tool 10 is capable of performing both the boring and cutting operations necessary to remove a solid, material such as coke from a container or coke drum without removing the tool 10 from the coke drum. Simplified changeover between boring and cutting operations may be done by an operator at a remote location by pressurizing and partially depressurizing tool 10 to actuate a pilot valve generally designated by the reference numeral 11. Changeover this simple and controlled at a remote location has not been possible prior to the present invention.

To perform the boring operation, tool 10 includes a plurality of boring nozzles 12 (in the preferred embodiment five nozzles 12 are shown) mounted in a boring head 14. Boring nozzles 12 direct jets of high pressure working fluid (for example, water) into a coke bed boring a pilot hole. To protect nozzles 12 from large pieces of coke that break away during boring, protective blades 16 are mounted on the boring head 14 equidistant between nozzles 12.

Figure 3A:
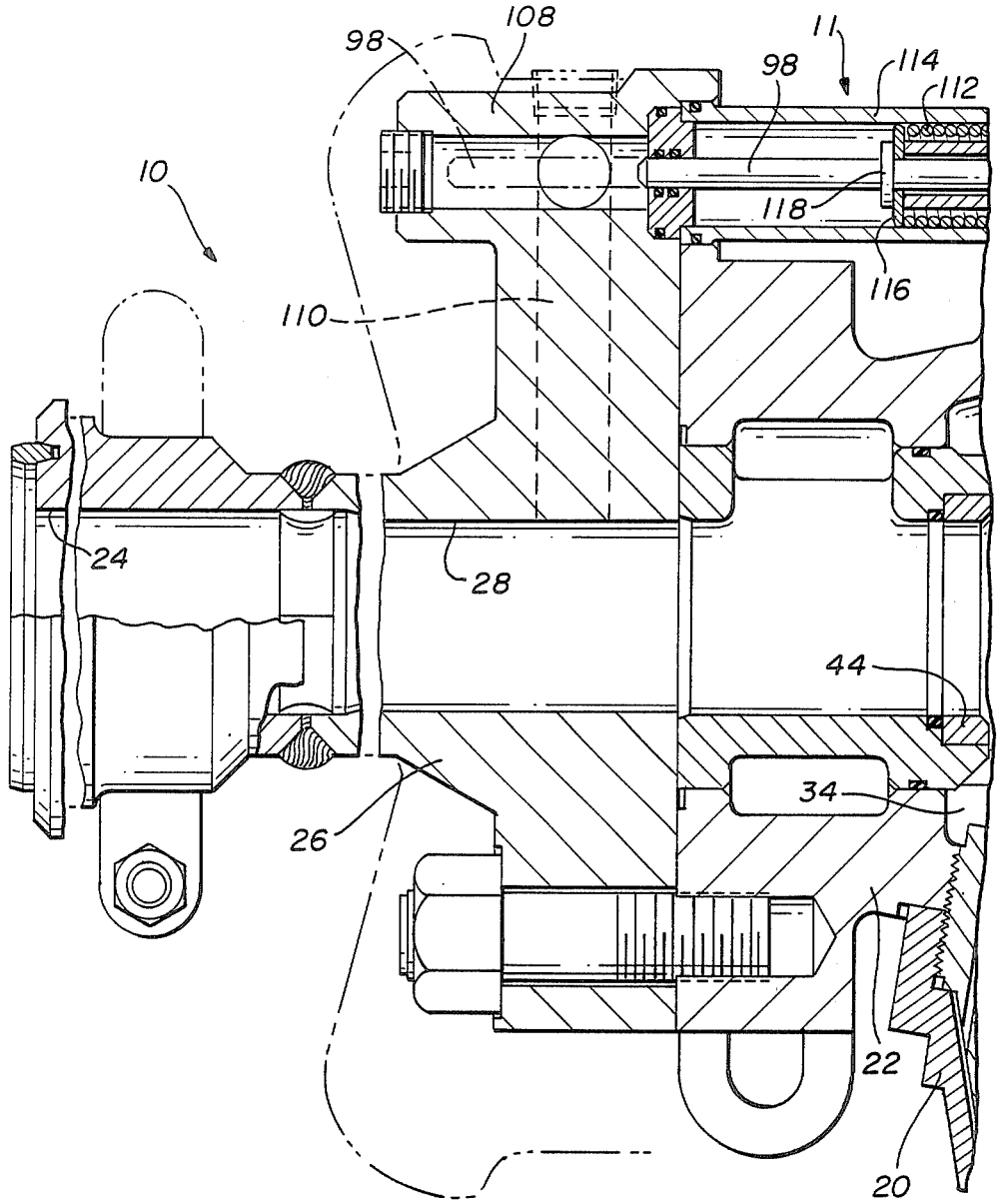
FIG. 3A is a vertical, cross sectional, partial view of the decoking tool taken generally along line 3—3 of FIG. 2 illustrating the inlet portion of the tool.
Figure 3B:
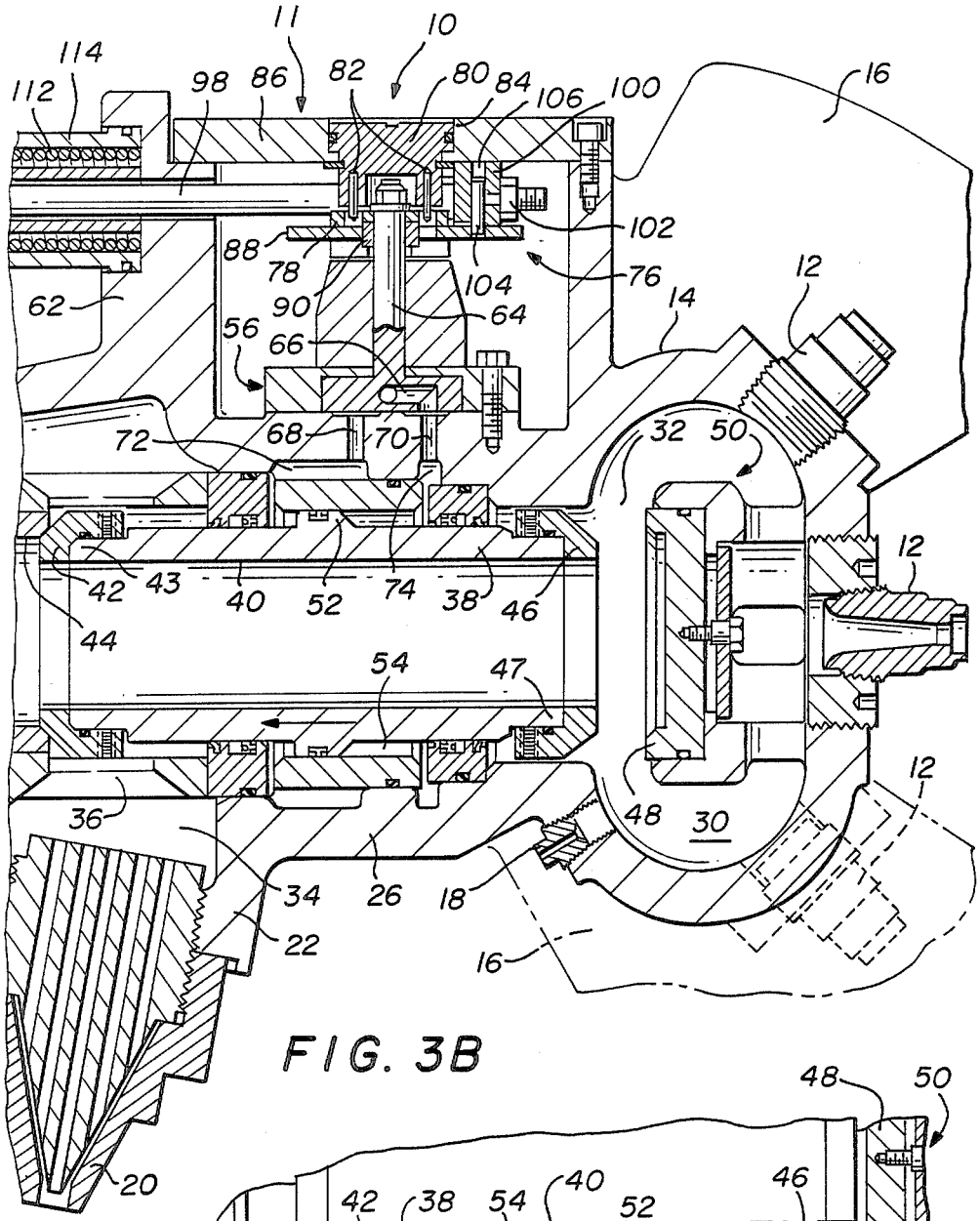
FIG. 3B is a vertical, cross sectional, partial view of the decoking tool in the boring mode taken generally along line 3—3 of FIG. 2 illustrating the portion of the tool extending from the inlet portion illustrated in FIG. 3A toward the boring head of the tool.
Figure 3B:
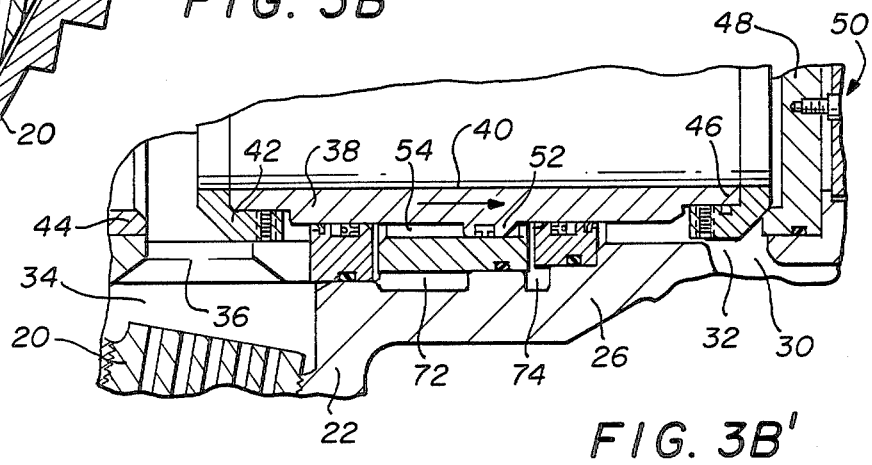

Fines generated during boring could settle on tool 10 during operation, lodging the tool 10 and preventing further movement. To prevent this, two backflush nozzles 18 are mounted in boring head 14 as shown in FIG. 3B. This results in high pressure working fluid being directed through the back flush nozzles 18 to agitate the fines in fashion preventing them from settling on the tool 10.

Cutting coke from a coke drum after completion of the boring operation involves directing jets of working fluid horizontally as tool 10 is advanced into the coke drum. As the coke is broken up during the cutting operation, it is flushed down the pilot hole and out of the coke drum. To perform the cutting operation, tool 10 includes a plurality of cutting nozzles 20 mounted in a cutting head 22. While boring nozzles 12 are mounted to direct jets of working fluid forward of tool 10, cutting nozzles 20 direct jets of working fluid substantially perpendicular or horizontally of tool 10.

Pressurized working fluid is communicated to the boring head 14 and cutting head 22 through an inlet 24 which is part of the body 26 of tool 10. As shown in FIG. 3A, the tool body 26 includes an elongated bore 28 communicating boring head 14 and cutting head 22 with inlet 24. To distribute working fluid communicated from inlet 24 to boring nozzles 12, boring head 14 includes a plenum chamber 30 adjacent boring nozzles 12. Plenum chamber 30 communicates with inlet 24 through an inlet port 32. Similarly, cutting head 22 includes a plenum chamber 34 adjacent nozzles 20. Plenum chamber 34 communicates with inlet 24 through an inlet port 36.

Tool 10 may be changed from boring to cutting or cutting to boring without the need to remove the tool 10 from the coke chamber. Changeover between these operations is accomplished using working fluid pressure to actuate a shuttle valve or sleeve 38 reciprocally mounted in bore 28. Shuttle valve 38 is tubular with a central bore 40 coincident with bore 28. Shuttle valve 38 controls the operation mode of tool 10 by controlling flow of pressurized working fluid to boring head 14 and to cutting head 22. In a first position of shuttle valve 38 (FIG. 3B), flow of pressurized working fluid is directed to boring head 14 while flow of pressurized fluid to cutting head 22 is blocked. This first position of shuttle valve 38 corresponds to the boring operation of tool 10. In a second position of shuttle valve 38 (FIG. 3B') flow of pressurized working fluid to boring head 14 is blocked. This second position of shuttle valve 38 corresponds to the cutting operation of tool 10.

During the boring operation of tool 10, shuttle valve 38 is in the first position (FIG. 3B) with a sleeve seal 42 on a first end 43 of sleeve valve 38 engaging a stationary seat 44 secured on tool body 26. Engagement of seal 42 and seat 44 closes inlet port 36 and blocks flow of pressurized working fluid to cutting nozzles 20. Flow of working fluid is not blocked, however, to boring nozzles 12. In the first position of shuttle valve 38, pressurized working fluid flows through bore 40 and inlet port 32 to plenum chamber 30. Working fluid then is directed through boring nozzles 12 into the coke bed.

During the cutting operation of tool 10, shuttle valve 38 is in the second position (FIG. 3B') with a second sleeve seal 46 on a second end 47 of shuttle valve 38 engaging a second stationary seat 48. Seat 48 is secured to boring head 14 by a retainer assembly 50. Engagement of seal 46 and seat 48 closes inlet port 32 blocking flow of pressurized working fluid to boring nozzles 12. Flow of pressurized working fluid is not blocked, however, to cutting nozzles 20. In the second position of shuttle valve 38, pressurized working fluid flows through inlet port 36 to plenum chamber 34. Working fluid is then directed through cutting nozzles 20 into the coke bed surrounding tool 10.

Changeover between boring and cutting operations is accomplished by actuating shuttle valve 38 between the first and second positions using working fluid pressure. Use of shuttle valve 38 actuated by working fluid pressure eliminates the need to remove tool 10 from the coke drum to change the operation of the tool 10. Actuation of shuttle valve 38 between the first and second positions is accomplished by the pilot valve 11 which directs working fluid pressure to a selected side of a flange or differential area 52 defined on the outer periphery of shuttle valve 38. Flange 52 extends into a chamber 54 surrounding the periphery of shuttle valve 38. To achieve the full advantage of the present invention, pilot valve 11 is actuated by an operator at a remote location to pressurize chamber 54 on one side of flange or differential area 52 and vent the other side. The pressurized working fluid in chamber 54 acts against the pressure reactive surface defined by flange or area 52 to move shuttle sleeve 38 to the first or second position depending on the initial position of sleeve 38 and the side of flange 52 on which working fluid pressure is introduced.

Figure 4:
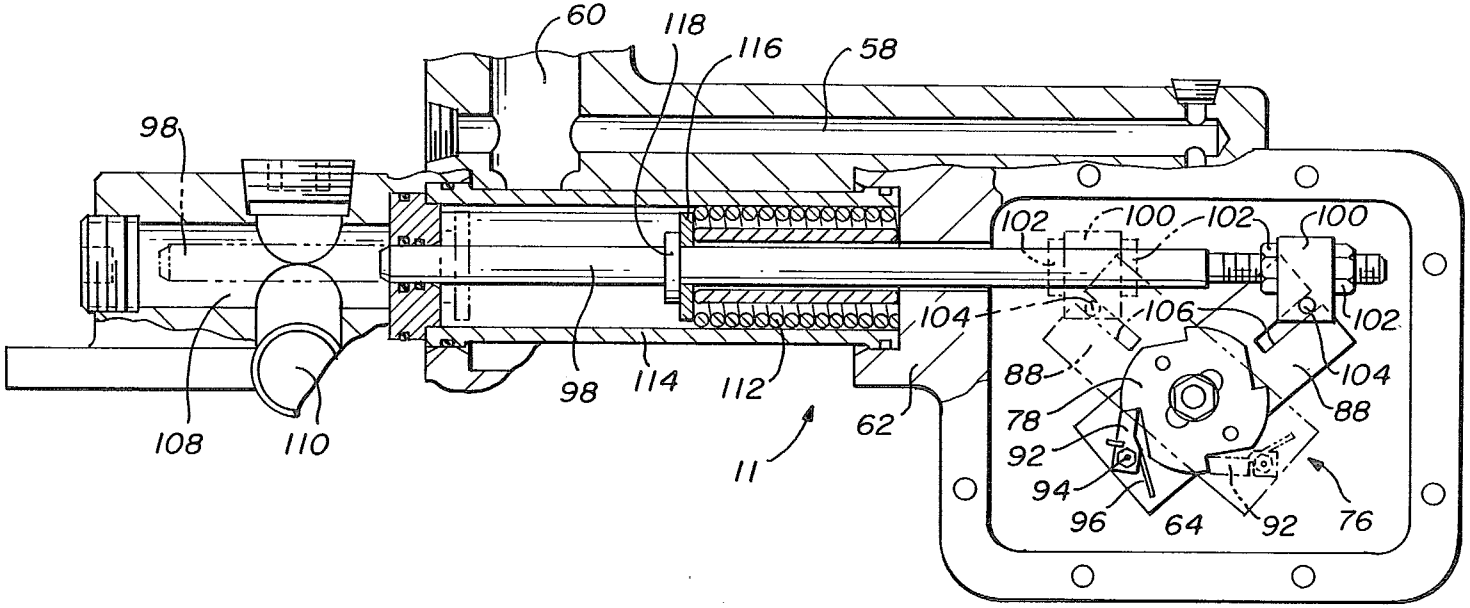
FIG. 4 is a vertical, cross sectional view taken substantially along line 4—4 in FIG. 2 illustrating the pilot valve used with the tool.

Introduction of working fluid pressure to chamber 54 is controlled by a plate valve 56 which is part of pilot valve 11. Pressurized working fluid is communicated to plate valve 56 by a conduit 58 (FIG. 4) in communication with a passage 60 coupled to the source of pressurized working fluid. Plate valve 56 is rotatably mounted in the housing 62 of pilot valve 11 and is rotated by stem 64. A passage network 66 is fabricated in plate valve 56 and is in communication with conduit 58. By rotating plate valve 56 in 90° increments, passage 66 is alternately aligned with passages 68 and 70 in tool body 26. Passage 68 communicates with a chamber 72 in communication with chamber 54 on a first side of flange or differential area 52. Passage 70 communicates with a chamber 74 in communication with chamber 54 on a second side of flange or differential area 52. By aligning passage 66 with passage 70, for example, working fluid pressure is introduced on a first side of flange or area 52 and the other side is vented by any suitable technique, such as venting through the clearances between the rotor and housing of valve 56, to cause shuttle valve 38 to move or shift to the first position corresponding to the boring operation of tool 10 (FIG. 3B). Rotating plate valve 56 to align passage 66 with passage 68 moves shuttle valve 38 to the second position corresponding to the cutting operation of tool 10 (FIG. 3B').

Rotation of plate valve 56 and thus, changeover between operations of tool 10, may be accomplished by an operator at a remote location through the use of a ratchet assembly generally designated by the reference numeral 76. Ratchet assembly 76 is a component of pilot valve 11 and is mounted in pilot valve housing 62. Ratchet assembly 76 is connected to stem 64 of plate valve 56 by a ratchet 78 which is rigidly secured to stem 64. Ratchet 78 is also connected to a position indictor 80 by pins 82. Position indicator 80 is rotatably mounted in a recess 84 fabricated in cover 86 of pilot valve housing 62. Rotation of ratchet 78, described in more detail hereinafter, will rotate plate valve 56 changing the operation of tool 10 and will rotate position indicator 80 to indicate the operation mode the tool 10. An indication of the operation mode of tool 10 at any time is helpful during servicing or similar procedures.

Ratchet 78 is rotated by a lever 88. Lever 88 is rotatably mounted on plate valve stem 64 by a spacer 90. A pawl 92 (FIG. 4) is pivotally mounted on lever 88 by a pin 94 and biased into engagement with the teeth of ratchet 78 by a spring 96. Lever 88 is rotated about stem 64 by reciprocal movement of a pilot piston 98. Pilot piston 98 is reciprocally mounted in pilot valve housing 62 and, in a manner to be described, is reciprocated by an operator at a remote location by controlling the pressure of the working fluid introduced to tool 10. Lever 88 is coupled to pilot piston 98 by a pin and slot arrangement which translates the linear motion of pilot piston 98 into rotational motion of lever 88. A cam 100 is threadedly mounted on pilot piston 98 and locked in position by a pair of nuts 102. A pin 104 is mounted in cam 100 and extends into a slot 106 in lever 88. Through this connection, reciprocation of pilot piston 98 rotates lever 88 from the position illustrated in solid lines in FIG. 4 to the position in dotted lines advancing the pawl 92. Movement of the pilot piston 98 a second-time rotates ratchet 78 90° rotating stem 64 and plate valve 56 to change the operation of tool 10.

As previously described, reciprocation of pilot piston 98 may be accomplished by an operator at a remote location. This is possible by partially depressurizing and repressurizing a piston chamber 108 into which pilot piston 98 extends. Piston chamber 108 is in communication with working fluid pressure at inlet 24 through a passage 110. By partially lowering the working fluid pressure introduced to tool 10 at inlet 24, an operator may partially depressurize and repressurize piston chamber 108. When relatively low pressure is present in tool 10, a spring 112 mounted in a spring tube 114 acts between the pilot valve housing 62 and a spring plate 116 and flange 118 on pilot piston 98 to bias pilot piston 98 into piston chamber 108 (dotted lines in FIGS. 3A and 4). Lever 88 is also rotated (dotted lines in FIGS. 3A and 4) advancing pawl 92. When working pressure in tool 10 is increased, pilot piston 98 is forced out of chamber 108 (solid lines in FIGS. 3A and 4) rotating ratchet 78 and plate valve 56 to change the operation of tool 10. This changeover is accomplished without removal of tool 10 from the coke chamber and is performed by an operator at a remote location. Neither of these features has been possible prior to the present invention. The water flowing through tool 10 in the decoking operation is typically drawn from a large volume settling pond and recirculated to that pond after use to settle out some of the contaminants entrained in the decoking operation. Even so, coke fines remain in the water and are continuously recirculated through the high pressure supply pump and the decoking tool 10. However, the design of tool 10 ensures its reliable operation, even in the presence of the recirculated coke fines.

Many modifications and variations of the present invention are possible in light of the above teachings. Thus, it is to be understood that, the invention may be practiced otherwise than as specifically described.

What is claimed and desired to be secured by Letters Patent of the United States is:

1. A decoking tool capable of boring and cutting for removing coke from a container with a source of high pressure fluid, the high pressure fluid being recirculated and containing coke fines, comprising:

a tool body, said body including inlet means for communicating said body with the (a) source of high pressure fluid containing fines, a first set of nozzles defined in said body, a second set of nozzles defined in said body, first means communicating said inlet means with said first set of nozzles, second means communicating said inlet means with said second set of said nozzles, a fluid actuated valve member reciprocally mounted in said body shiftable in response to fluid pressure between a first position blocking said first communicating means and forming a main fluid flow path by directing full pressure fluid through said second communicating means and a second position blocking said second communicating means and forming the main fluid flow path by directing full fluid pressure through said first communicating means, and means associated with said valve member for shifting said valve member between said first and second positions, said means for shifting being responsive to means for reacting to pressure interruptions in said inlet means, such that an interruption in fluid pressure causes said valve member to change positions from one of said first and second positions to the other of said positions and remain in the other position after the interruption in fluid pressure is ceased, said shifting means and said reacting means positioned outside the main fluid flow path to reduce erosion and clogging effects of fines in the fluid flow.

2. A tool capable of boring and cutting for removing solid material from a container, comprising:

a tool body, said body including inlet means for communicating said body with a source of high pressure fluid, a first set of nozzles defined in said body, a second set of nozzles defined in said body, first means communicating said inlet means with said first set of nozzles, second means communicating said inlet means with said second set of said nozzles, a fluid actuated valve member reciprocally mounted in said body shiftable in response to fluid pressure between a first position blocking said first communicating means and directing full fluid pressure through said second communicating means and a second position blocking said second communicating means and directing full fluid pressure through said first communicating means, means associated with said valve member for shifting said valve member between said first and second positions, said means for shifting being responsive to means for reacting to pressure interruptions in said inlet means, such that an interruption in fluid pressure causes said valve member to change positions from one of said first and second positions to the other of said positions and remain in the other position after the interruption in fluid pressure is ceased wherein said means for shifting said valve member includes a seal defining a differential area on an external surface of said valve member.

3. A tool capable of boring and cutting for removing solid material from a container, comprising:

a tool body, said body including inlet means for communicating said body with a source of high pressure fluid, a first set of nozzles defined in said body, a second set of nozzles defined in said body, first means communicating said inlet means with said first set of nozzles, second means communicating said inlet means with said second set of said nozzles, a fluid actuated valve member reciprocally mounted in said body shiftable in response to fluid pressure between a first position blocking said first communicating means and directing full fluid pressure through said second communicating means and a second position blocking said second communicating means and directing full fluid pressure through said first communicating means, means associated with said valve member for shifting said valve member between said first and second positions, said means for shifting being responsive to means for reacting to pressure interruptions in said inlet means, such that an interruption in fluid pressure causes said valve member to change positions from one of said first and second positions to the other of said positions and remain in the other position after the interruption in fluid pressure is ceased wherein said means for reacting comprises a pilot valve, said pilot valve including an inlet in communication with said source of high pressure fluid, said pilot valve including communication means for selectively communicating said high pressure to said fluid actuated valve member to move said valve member between said first and second positions.

4. A tool capable of boring and cutting for removing solid material from a container, comprising:

a tool body, said body including inlet means for communicating said body with a source of high pressure fluid, a first set of nozzles defined in said body, a second set of nozzles defined in said body, first means communicating said inlet means with said first set of nozzles, second means communicating said inlet means with said second set of said nozzles, a fluid actuated valve member reciprocally mounted in said body shiftable in response to fluid pressure between a first position blocking said first communicating means and directing full fluid pressure through said second communicating means and a second position blocking said second communicating means and directing full fluid pressure through said first communicating means, means associated with said valve member for shifting said valve member between said first and second positions, said means for shifting being responsive to means for reacting to pressure interruptions in said inlet means, such that an interruption in fluid pressure causes said valve member to change positions from one of said first and second positions to the other of said positions and remain in the other position after the interruption in fluid pressure is ceased:

wherein said means for reacting comprises pilot valve means for selectively directing fluid from said source of high pressure fluid to said fluid actuated valve, said pilot valve means including a piston, a spring biasing said piston to a first position inside a first chamber, means for communicating said first chamber with said source of high pressure fluid, a cam on said piston, a lever coupled to said cam, a pawl secured to said lever, said pawl engaging a ratchet, and means for controlling the flow of high pressure fluid to said valve member to move said valve member between said first and second positions, said controlling means actuated by said ratchet.

5. A decoking tool for boring and cutting coke, comprising:

a tool body, said body including a cavity and means for introduction of high pressure fluid into said cavity, a boring head connected to said body, a first plurality of nozzles defined in said boring head, a cutting head in said body, a second plurality of nozzles defined in said cutting head, a first inlet port communicating said high pressure fluid introduction means with said second plurality of nozzles in said cutting head, a second inlet port communicating said high pressure fluid introduction means with said first plurality of nozzles in said boring head, a fluid actuated valve reciprocally mounted in said cavity operable by said high pressure fluid to a first position closing said first inlet port and opening said second inlet port and to a second position closing said second inlet port and opening said first inlet port, and pilot valve means for controlling communication of said high pressure fluid to said fluid actuated valve for actuation thereof in response to interruptions in the pressure of said fluid in said cavity.

6. The decoking tool claimed in claim 5 wherein said fluid actuated valve comprises a fluid pressure reactive differential area valve.

7. The decoking tool claimed in claim 5 wherein said pilot valve includes a piston, means for communicating said piston with said high pressure fluid to actuate said piston, a spring mounted on said piston biasing said piston to a first position, a cam on said piston, a lever secured to said cam, a pawl on said lever, and a ratchet actuated by said pawl.

8. The decoking tool claimed in claim 7 wherein said ratchet is mounted on and actuates a valve controlling the communication of high pressure fluid to said fluid actuated valve to actuate said fluid actuated valve.

9. A decoking tool operable to perform boring and cutting operations without withdrawing said tool from a coke bed, comprising:

a tool body including an inlet for connection to a controllable source of high pressure working fluid, a boring head on said body including a first set of nozzles, a cutting head on said body including a second set of nozzles, first means for communicating said inlet to said boring head, second means for communicating said inlet to said cutting head, a valve member in said body actuable to a first position by said working fluid to block said first means and open said second means and actuable to a second position to block said second means and open said first means, pilot valve means for directing said working fluid to said valve member to move said valve member between said first and second positions, and means actuated by said working fluid for actuating said pilot valve means.

10. The decoking tool set forth in claim 9 wherein said body includes a chamber surrounding said valve member, said valve member including a differential area, communicating means for communicating said working fluid from said pilot valve to said chamber to actuate said valve member.

11. The decoking tool set forth in claim 9 wherein said pilot valve actuating means includes a pilot chamber, means for communicating said working fluid to said pilot chamber, a piston extending into said pilot chamber, a ratchet assembly connected to said piston, said pilot valve means including working fluid directing means operable by said ratchet assembly for directing working fluid to said valve member for actuation thereof.

* * * * *